US007258429B2

(12) United States Patent
Takahashi et al.

(10) Patent No.: US 7,258,429 B2
(45) Date of Patent: Aug. 21, 2007

(54) ADJUSTMENT METHOD OF DOT PRINTING POSITION AND PRINTING SYSTEM

(75) Inventors: Kiichiro Takahashi, Kanagawa (JP); Minoru Teshigawara, Kanagawa (JP); Satoshi Seki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 370 days.

(21) Appl. No.: 10/929,447

(22) Filed: Aug. 31, 2004

(65) Prior Publication Data

US 2005/0052494 A1 Mar. 10, 2005

(30) Foreign Application Priority Data

Sep. 5, 2003 (JP) ..... 2003-314427

(51) Int. Cl.
*B41J 2/12* (2006.01)
*B41J 29/393* (2006.01)

(52) U.S. Cl. ..... 347/78; 347/19; 347/77

(58) Field of Classification Search ..... 347/78
See application file for complete search history.

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,608,577 | A | 8/1986 | Hori | |
| 4,723,129 | A | 2/1988 | Endo et al. | |
| 4,740,796 | A | 4/1988 | Endo et al. | |
| 6,015,207 | A * | 1/2000 | Winter et al. | 347/43 |
| 6,168,261 | B1 | 1/2001 | Miyake et al. | |
| 6,196,736 | B1 * | 3/2001 | Otsuki et al. | 400/124.01 |
| 6,257,143 | B1 * | 7/2001 | Iwasaki et al. | 101/481 |
| 6,371,592 | B1 | 4/2002 | Otsuka et al. | |
| 6,454,390 | B1 | 9/2002 | Takahashi et al. | |
| 2004/0046813 | A1 | 3/2004 | Edamura et al. | |
| 2004/0113963 | A1 * | 6/2004 | Tsujimoto | 347/14 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 11-291470 | 10/1999 |

* cited by examiner

*Primary Examiner*—Matthew Luu
*Assistant Examiner*—Brian J. Goldberg
(74) *Attorney, Agent, or Firm*—Fitzpatrick, Cella, Harper & Scinto

(57) ABSTRACT

A print position adjusting method capable of executing dot adjust value calculation processing in ways that can meet diversified user needs of recent years, and a printing system that can realize the print position adjusting method are provided. Multiple kinds of dot adjust value calculation processing capable of acquiring an adjust value for aligning print positions are prepared, so that the user can select a desired one. With this arrangement, the user can execute the desired dot adjust value calculation processing as necessary.

9 Claims, 11 Drawing Sheets

ADJUSTMENT METHOD OF DOT PRINTING POSITION AND PRINTING SYSTEM

BACKGROUND OF THE INVENTION

1. Field of the Invention

The present invention relates to a dot print position adjusting method in a dot matrix printing and to a printing system using this method. More specifically, the invention relates to a print position adjustment to align positions of dots formed by a forward scan and a backward scan in a bidirectional printing and to a print position adjustment to align positions of dots formed by a plurality of print heads.

2. Description of the Related Art

Relatively inexpensive personal computers, word processors and other office equipment have proliferated in recent years. Under these circumstances, printing apparatus to print information from these devices and technologies to increase a printing speed and enhance an image quality of the printing apparatus are being developed one after another. Among the printing apparatus, a serial printer using the dot matrix printing method has attracted attention as a printer that can realize a fast or high quality printing at low cost.

In a printing apparatus that performs a bidirectional printing for an increased speed, if positions on a print medium of dots formed by a forward scan and of dots formed by a backward scan deviate from each other, an image degradation such as line misalignment occurs. That is, when vertical lines perpendicular to the scan direction of the print head are formed by forward scans and backward scans alternately, the positions of dots formed by the forward and backward scans may fail to align, resulting in vertical ruled lines with low straightness. This line misalignment is one of the most popular image impairments observed by the user. Ruled lines are often printed in black and thus the line misalignment tends to be recognized as a problem encountered in black images. The similar problem, however, also occurs with color images.

Such a print position misalignment between the forward and backward scans produces another image impairment called "texture" during a multipass printing which is performed to enhance a print quality. In the multipass printing, print data that can be printed in one scan of print head is masked using a predetermined culling or thinning pattern. In one and the same print area on the print medium an image is formed in two or more scans using a plurality of culling patterns that are complementary to one another. Thus a phenomenon such as the aforementioned line misalignment is unlikely to be observed. However, if a culling pattern used in the forward scan and a culling pattern used in the backward scan deviate from each other, a resulting image will become ununiform. This ununiform image appears in a cycle that depends on the applied mask pattern, so when the entire image is looked at, an unpleasant pattern or texture shows over the entire image. This texture tends to become particularly noticeable in half tone areas of the image printed at high density and high contrast, as when the image is printed in monochrome or on coated paper.

Further, in a printing apparatus with a plurality of print heads, such as yellow, magenta, cyan and black color heads, for example, if dot landing positions from the four print heads deviate from each other, a phenomenon called "color deviation" occurs on the printed image. The color deviation will be briefly explained as follows.

When a blue color is to be formed, a magenta ink and a cyan ink are used. An area on a print medium where dots of the two colors overlap and an area where they do not, produce slightly different colors. In a uniform blue color image, an area with a slightly differing color, if it is small, does not show in the image. But if the dot deviation between the magenta and cyan print heads occurs only during a particular scan, only the areas printed by that scan show up their color difference in the form of bands, resulting in an uneven blue color image. This phenomenon is referred to as "color deviation" in this specification. The "color deviation" does not show so much on plain paper, but on print mediums that produce highly saturated colors, such as coated paper, tends to become more noticeable.

When different colors are printed at adjoining positions by a plurality of print heads, if a deviation occurs between the different colors, an unprinted area or gap is formed at the deviated dot portions, allowing the color of the print medium to be exposed. Since print mediums are mostly white, this phenomenon is called "white blanking." This phenomenon is particularly noticeable on an image with a strong contrast. For example, in a black image on a color background, if there is an unprinted white area between the black area and the color area, the blank area clearly shows up because of the strong contrast between white and black.

To minimize the above image impairments, many printing apparatus on the market adopt dot adjust value calculation processing. The dot adjust value calculation processing in this specification means processing which—in a printing apparatus forming an image by two printing operations with different printing conditions, such as a first printing during a forward scan and a second printing during a backward scan—calculates an adjust value for aligning the print positions of the first and second printing. The adjust value acquired by the dot adjust value calculation processing denotes such a correction value to adjust timings at which the print head ejects ink during the forward and backward scans in order to align the print positions of the forward scan and the backward scan in a bidirectional printing.

A general procedure of the dot adjust value calculation processing will be explained in the following by taking a bidirectional printing as an example. First, the printing apparatus prints on a print medium a plurality of line patterns in such a manner backward scan print positions relative to the associated forward scan print positions differ from one another while adjusting ink ejection timing. The user visually checks the printed line patterns and selects one with the best straightness. Then, a parameter representing the selected line pattern is entered into the printing apparatus either by directly operating keys on the apparatus or operating a host computer connected to the printing apparatus. The printing apparatus sets optimum ejection timings for the forward scan and the backward scan-based on the parameter entered. After this, when a printing operation is to be done, the print scans are controlled according to the set ejection timings.

When the dot adjust value calculation processing is performed between a plurality of print heads, a plurality of line patterns are printed on one and the same straight line by the print heads. At this time, the line patterns are printed by differentiating their relative ink ejection timings. The user visually checks the printed line patterns and selects one with the least misalignment. Then, a parameter representing the selected line pattern is entered into the printing apparatus either by directly operating keys on the apparatus or operating a host computer connected to the printing apparatus. The printing apparatus sets optimum ejection timings for individual print heads based on the parameter entered. After this, when a printing operation is to be done, the print heads are controlled according to the set ejection timings.

What has been described above is a method that outputs a test pattern for a visual check by the user (referred to as manual dot adjust value calculation processing). This method, however, not only is cumbersome for the user but also is not immune from a possibility of misjudgment and faulty operation. Thus in recent years, a method of automatically performing the dot adjust value calculation processing by using an optical sensor (referred to as automatic dot adjust value calculation processing) has been proposed and put to practical use (e.g., Japanese Patent Application Laid-open No. 11-291470).

The automatic dot adjust value calculation processing disclosed in Japanese Patent Application Laid-open No. 11-291470 will be briefly explained as follows. First, as with the manual dot adjust value calculation processing, a predetermined test pattern is printed by the forward and backward scan of a print head or by a plurality of print heads. Next, a plurality of pattern is printed by shifting other dots (those dots formed, for example, by the backward scan or color print heads) from reference dots (those dots formed, for instance, by the forward scan or a black print head).

The patterns printed in a plurality of different conditions have different area factors (percentage of a dot-occupied area with respect to an overall area of interest) because dots printed under different conditions shift from each other. Based on this fact, the method proposed by Japanese Patent Application Laid-open No. 11-291470 measures an average density of each of the test patterns by an optical sensor, decides that a pattern with the highest average density is the one with the least dot deviation, and then automatically set optimum ejection timing for each scan of each print head. This automatic dot adjust value calculation processing obviates the need for cumbersome setting on the part of the user and eliminates a possibility of misjudgment and erroneous input.

It should be noted, however, that if the print position adjustment can only be done in the automatic dot adjust value calculation mode, the dot print position adjustment may become impossible in the event of a failure for some reason during the automatic dot adjust value calculation processing. Thus, Japanese Patent Application Laid-open No. 11-291470 discloses a construction that provides both the automatic dot adjust value calculation processing and the manual dot adjust value calculation processing and which prompts the user to perform the manual dot adjust value calculation processing only when the automatic dot adjust value calculation processing fails.

As described above, the manual dot adjust value calculation processing requires a cumbersome procedure on the part of the user, who must perform many steps involving outputting test patterns, visually checking them, selecting an optimum condition and entering an associated parameter. Since the determination of a set value is left to the user's judgment, there is a possibility of an erroneous setting. Further, since it takes long to complete the procedure from the test pattern output to the final setting, this manual mode is not advantageous also in terms of time performance. For a novice user the above procedure is particularly cumbersome and is not highly evaluated in terms of customer satisfaction. However, for a user already accustomed to the printing apparatus, since the manual mode allows the user to make his or her own adjustment with a satisfactory precision while the user checks himself, the manual mode may give the user a better impression than the automatic mode.

As to the automatic dot adjust value calculation processing that automatically performs the entire procedure from the test pattern output to the final adjust value judgment, this mode eliminates the input work on the part of the user and the time performance problem and thus, from the standpoint of customer satisfaction, is considered a highly advantageous method. However, the user wishing for a high image quality and who knows how to use the printing apparatus may not like the fact that the automatic mode does not allow the user to check the adjustment procedure as it is processed.

Japanese Patent Application Laid-open No. 11-291470 discloses a method which allows a mode transfer from automatic to manual when the automatic dot adjust value calculation processing fails. Since the automatic dot adjust value calculation processing performs all steps in an open loop and thus is vulnerable to external disturbances, the countermeasure adopted by the cited reference is effective. For example, even when the user feels that something is wrong with the print position control, unless an error is detected during the automatic dot adjust value calculation processing, the print position adjustment continues as is in the automatic mode.

In the present ink jet printing apparatus the dot adjust value calculation processing is one of the preferred means that will contribute to a stable production of quality images. It is, however, difficult to meet all the requirements with a single dot adjust value calculation processing, whether automatic or manual. This is because there is a wide range of users of printing apparatus already in wide use, including those who want to make reliable, highly precise adjustments themselves even if the procedure takes time and many others who want cumbersome steps associated with printer maintenance to be executed automatically.

SUMMARY OF THE INVENTION

The present invention has been accomplished to overcome the above problems and it is an object of this invention to provide a dot position adjusting method that can perform the dot adjust value calculation processing to meet diversified user needs of recent years and also a printing system that can realize the dot position adjusting method.

In a first aspect of the present invention, there is provided a print position adjusting method for a printing apparatus that uses print heads and forms an image on a print medium by a first printing and a second printing with different printing conditions comprising the steps of: preparing multiple kinds of dot adjust value calculation processing capable of acquiring an adjust value for aligning print positions of dots formed by the first and second printing, the dot adjust value calculation processing having different levels of ease of operation for a user and different levels of accuracy; and accepting one selection made by the user from among the multiple kinds of dot adjust value calculation processing.

In a second aspect of the present invention, there is provided a printing system which uses print heads to form an image on a print medium by a first printing and a second printing with different printing conditions, the printing system comprising: multiple kinds of dot adjust value calculation processing modes capable of acquiring an adjust value for aligning print positions of dots formed by the first and second printing, the dot adjust value calculation processing modes having different levels of ease of operation for a user and different levels of accuracy; and means for accepting one selection made by the user from among the multiple kinds of dot adjust value.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Embodiments of this invention will be described in detail by referring to the accompanying drawings.

(Construction of Printing Apparatus)

Figure 1:
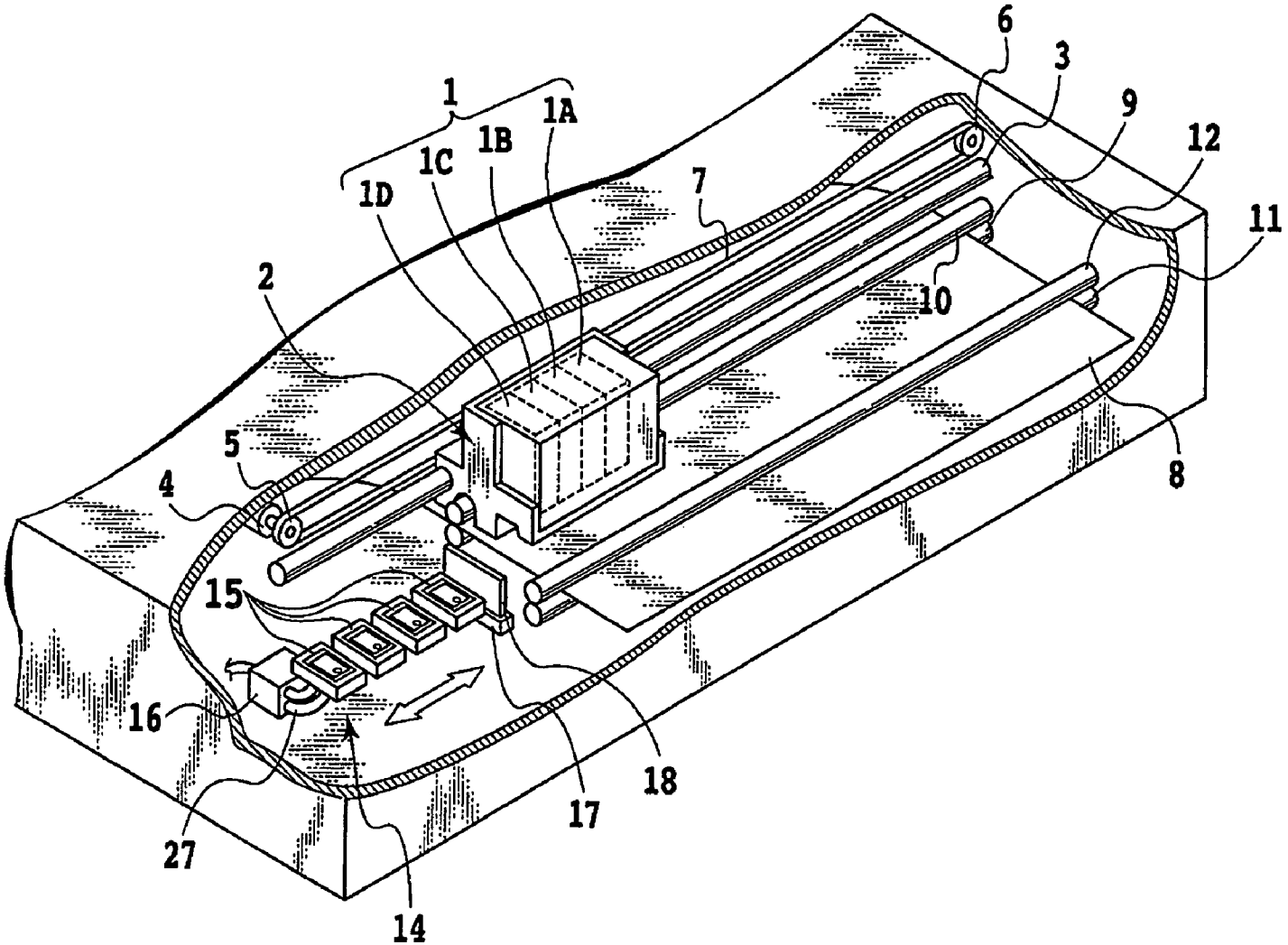
FIG. 1 is a perspective view schematically showing the construction of essential components of an ink jet printing apparatus that can apply this invention.

FIG. 1 is a perspective view schematically showing the construction of essential components in an ink jet printing apparatus that can apply this invention. In FIG. 1, reference numerals 1A, 1B, 1C and 1D represent head cartridges which are mounted on a carriage 2 so that they are individually replaceable. Each of the head cartridges 1A-1D is provided with a connector for receiving a head drive signal. In the following description the entire head cartridges 1A-1D or any one of them will be referred to as head cartridges (print head or print means) 1.

The individual head cartridges 1 eject inks of different colors. Ink tanks provided to the head cartridges 1 accommodate cyan (C), magenta (M), yellow (Y) and black (Bk) inks, for example. The head cartridges 1 are positioned and mounted on the carriage 2 so that they are individually replaceable. The carriage 2 has a connector holder (electric connection unit) to supply a drive signal to each of the head cartridges 1 through a connector.

The carriage 2 is supported on a guide shaft 3 installed in the printing apparatus body so that it is guided along the shaft in a main scan direction. The carriage 2 is driven by a main scan motor 4 through a motor pulley 5, a follower pulley 6 and a timing belt 7 for control of its position and movement.

A print medium 8 is transported by the rotation of two pairs of transport rollers 9, 10 and 11, 12 to pass through a position facing an ink ejection face of the head cartridges 1 (print unit). The print area of the print medium is supported at its back on a platen (not shown) to form a flat print surface. The two pairs of transport rollers (9 and 10; 11 and 12) also have a function of supporting the print medium 8 at forward and backward positions of the print area to keep the print medium 8 on the platen at a predetermined distance from the ink ejection face of the head cartridges 1 mounted on the carriage 2.

Though not shown in FIG. 1, the carriage 2 is attached with an optical sensor. The optical sensor used in this embodiment is either a red LED or infrared LED having a light emitting element and a light receiving element. These elements are set almost parallel to the print medium 8. The distance from the optical sensor to the print medium 8 is determined depending on a characteristic of the optical sensor used. In this embodiment this distance is set at around 6-8 mm. To minimize effects of mist produced by ink ejection from the head cartridges 1, the optical sensor is preferably covered with a cylindrical member.

The head cartridges 1 applied in this embodiment is a print means of an ink jet system with a plurality of print elements which generate a thermal energy to eject ink.

Figure 2:
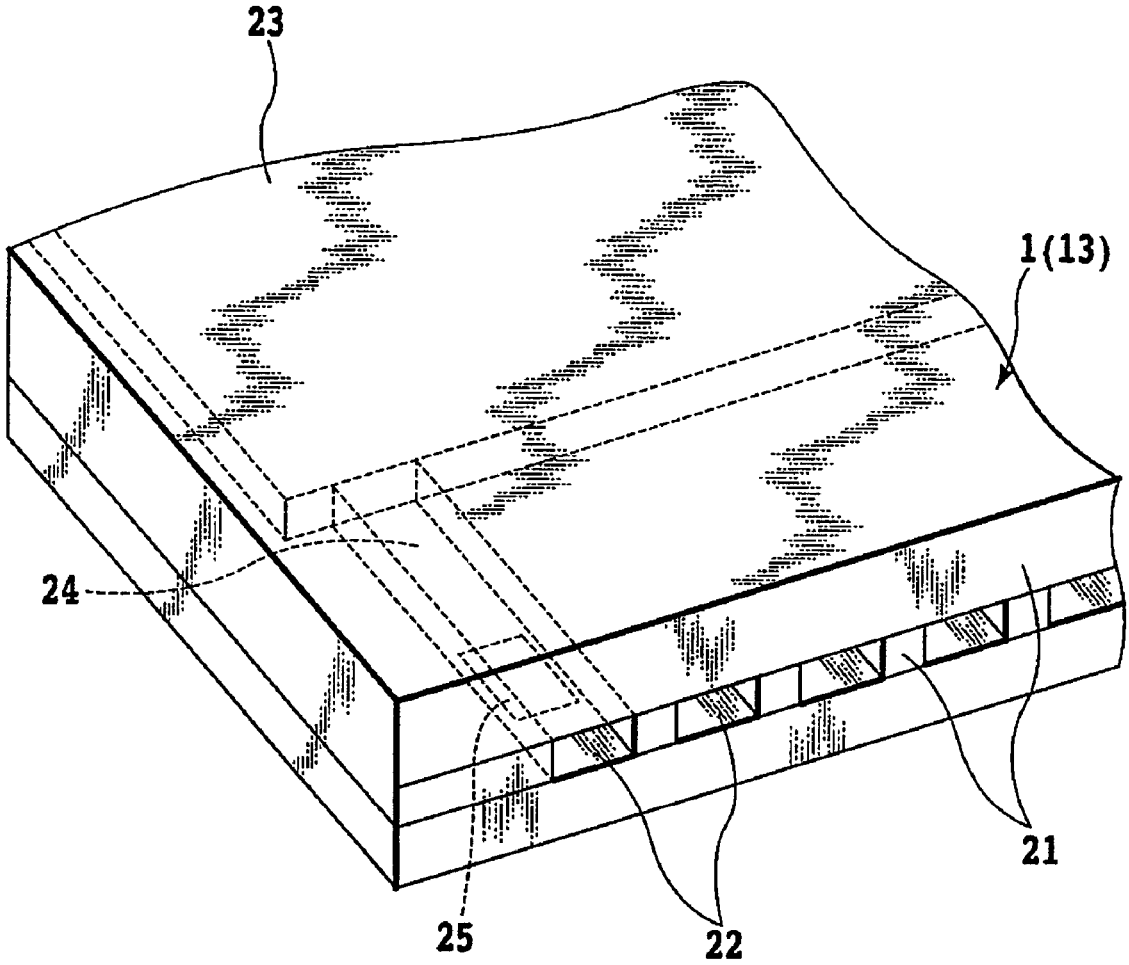
FIG. 2 is a schematic perspective view showing an essential construction of an ink ejection portion.

FIG. 2 is a schematic perspective view showing an essential construction of the ink ejection unit 13 in each of the head cartridges 1. In FIG. 2, an ejection face 21 opposes the print medium 8 with a predetermined gap (in this embodiment about 0.5-2 mm) therebetween. The ejection face 21 is formed with a plurality of nozzles 22 at a predetermined pitch in a direction crossing the scan direction of the carriage 2. Each of the nozzles 22 is communicated through a path 24 to a common liquid chamber 23. A space from the common liquid chamber 23 up to the nozzles 22 are filled with ink. On a wall surface of each path 24 is placed an electro-thermal transducer (such as a heating resistor; also referred to as an ejection heater) 25 that generates an energy to eject ink.

In an ink ejection operation a predetermined voltage is applied to each electro-thermal transducer 25 according to an image signal or ejection signal. The electro-thermal transducer 25 transforms an electric energy into a thermal energy which in turn heats the ink inside the path 24 causing a film boiling. Then, a rapidly growing bubble in the path pushes the ink toward the nozzle 22 by its pressure and shoots a predetermined amount of ink as an ink droplet from the nozzle. In this embodiment, as described above, the ink jet print head utilizes a pressure change caused by the bubble growth and contraction due to film boiling to eject ink from the nozzles 22.

In this embodiment the head cartridge 1 of one color comprises two nozzle columns, staggered by half a nozzle pitch from each other and arranged side by side in the scan direction of the carriage 2, each nozzle column having a plurality of nozzles arrayed in a direction crossing the scan direction of the carriage 2 as shown in FIG. 2. These nozzle columns are provided for a plurality of colors to form the head cartridges 1 which are mounted on the carriage 2.

(Configuration of Control Circuit)

Figure 3:
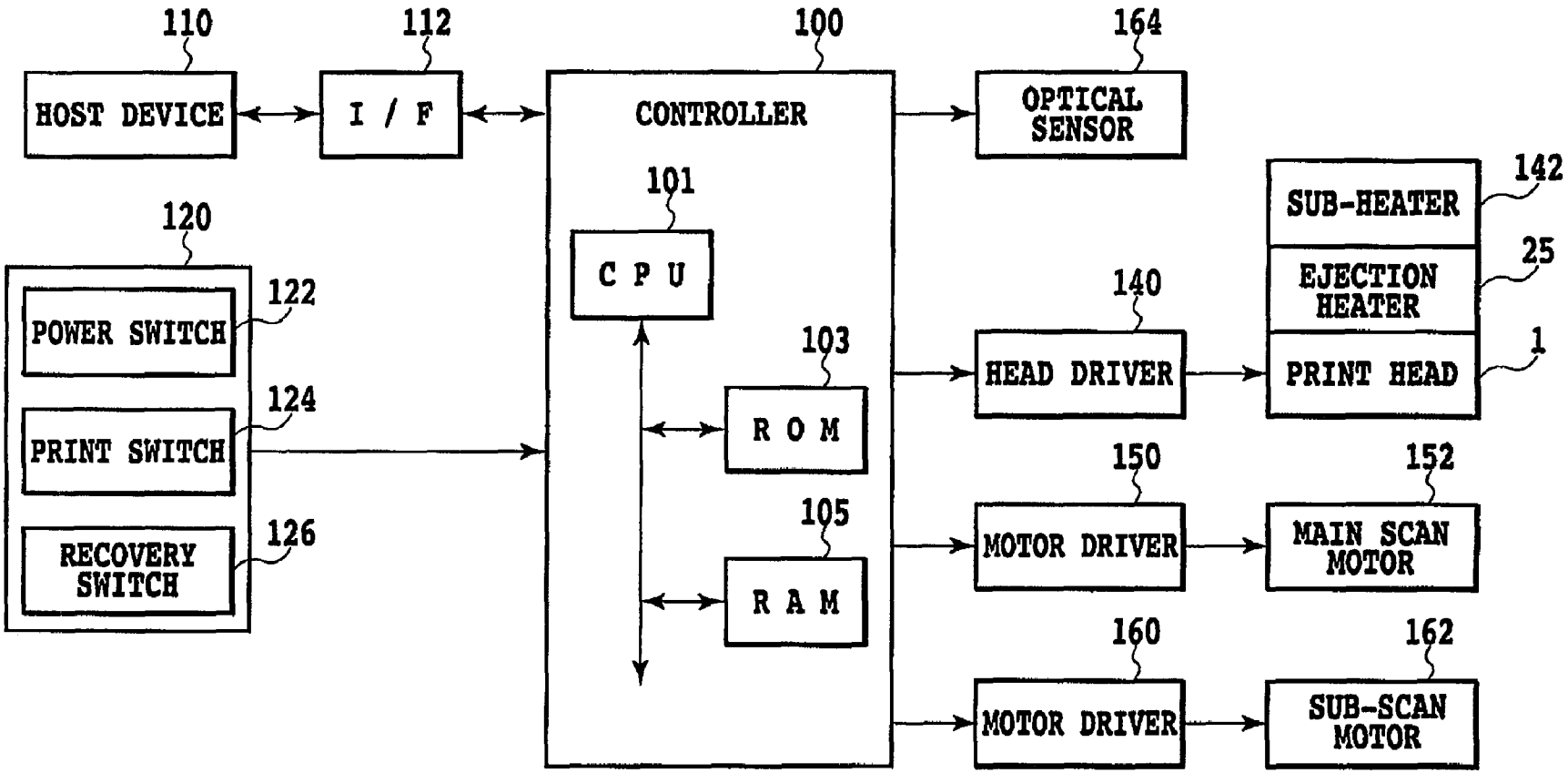
FIG. 3 is a block diagram showing a control configuration in an ink jet printing apparatus as one embodiment of this invention.

FIG. 3 is a block diagram showing a control configuration of the ink jet printing apparatus of this embodiment.

In FIG. 3, a controller 100 constitutes a main control unit and performs an overall control on the printing apparatus, such as drive control of the print heads 1. The controller 100 has a CPU 101 in the form of a microcomputer, for example, a ROM 103 storing a program, associated tables and other fixed data, and a RAM 105 having an area for rasterizing image data and a work area.

A host device 110 is a source of image data for the printing apparatus and may be a computer to generate and process print data or an image reader. Image data and commands output from the host device 110 are received by the controller 100 via an interface (I/F) 112. Status signals from the printing apparatus are sent through the interface (I/F) 112 to the host device 110.

An operation unit 120 has a group of switches by which the user inputs instructions, including a power switch 122, a print switch 124 to start a printing operation, and a recovery switch 126 to start a suction-based ejection performance recovery operation.

A head driver 140 drives ejection heaters 25 of the print heads 1 according to the print data. The head driver 140 has a shift register to arrange the print data at positions that match those of the ejection heaters 25, a latch circuit to latch the data at an appropriate timing, logic circuit elements to activate the ejection heaters 25 in synchronism with a drive timing signal, and a timing setting unit to properly set a drive timing (ejection timing) to match the dot forming positions.

The print heads 1 are each provided with a sub-heater 142 that adjusts a temperature of ink to stabilize the ink ejection characteristic. The sub-heater 142 may be formed on a substrate of the print head 1 simultaneously with the ejection heaters 25, or mounted on a part of the ink ejection unit 13 or head cartridge 1.

A motor driver 150 drives a main scan motor 152 to scan the carriage 2. A motor driver 160 drives a sub-scan motor 162 to feed the print medium 8 in the sub-scan direction.

Denoted 164 is an optical sensor which is used during the automatic dot adjust value calculation processing in this embodiment.

Now, the dot adjust value calculation processing most characteristic of this invention will be explained. It is assumed that the printing apparatus applied to this embodiment can perform a bidirectional printing in which one and the same print head performs printing in both the forward scan and the backward (or return) scan. It is also assumed that the printing apparatus has dot adjust value calculation processing to align positions of dots formed in the forward scan with positions of dots formed in the backward scan. Each of the print heads used in this embodiment has two nozzle columns for ejecting ink of one color. And the printing apparatus has dot adjust value calculation processing for adjusting the landing positions of dots ejected from each nozzle column. Further, the printing apparatus has dot adjust value calculation processing for adjusting print positions among a plurality of print heads of different color inks.

The ink jet printing apparatus of this embodiment has two modes, "simple dot adjust value calculation mode" and "detailed dot adjust value calculation mode." In each mode, above-described multiple kinds of dot adjust value calculation processing can be executed. In the following, the "simple dot adjust value calculation mode" in this embodiment will be explained.

The "simple dot adjust value calculation mode" in this embodiment is characterized in that the user can execute the dot adjust value calculation processing easily. Thus, the number of patterns output as test patterns is set small, so the processing can be finished in as short a time as possible. The procedure employed is also simple so as not to baffle the user. Further, since it is desired to prevent erroneous operations on the part of a novice user, the "automatic dot adjust value calculation processing" is employed which makes adjustments automatically using an optical sensor.

Figure 4:
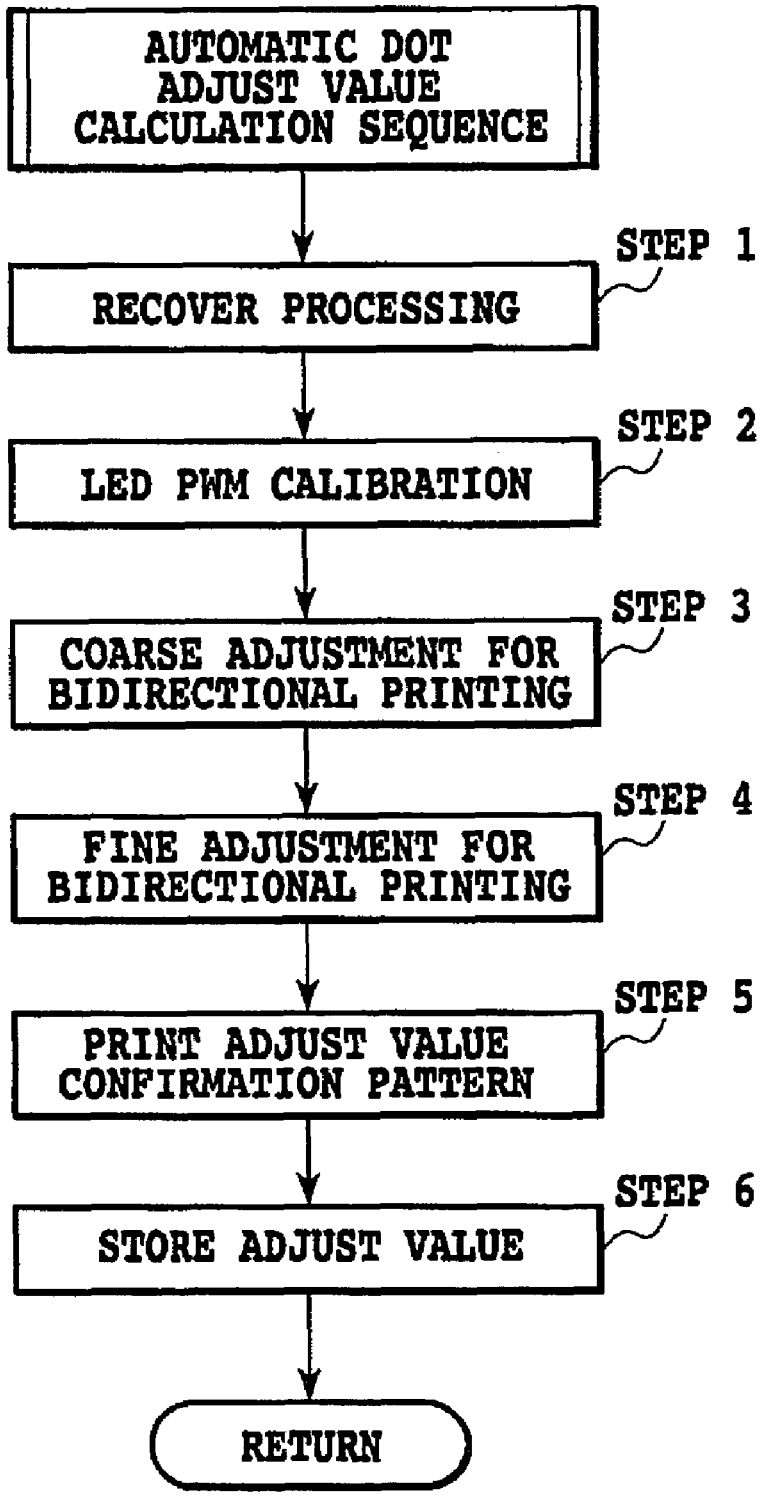
FIG. 4 is a flow chart showing a sequence of steps that CPU performs in the automatic dot adjust value calculation processing used in the embodiment of this invention.

FIG. 4 is a flow chart showing a sequence of steps performed by CPU 101 in the automatic dot adjust value calculation processing of this embodiment. For simplicity, only the dot adjust value calculation processing for the bidirectional scans will be described as an example.

When the automatic dot adjust value calculation processing is started, step 1 performs an ink ejection performance recovery operation on the print heads. The recovery operation in step 1 includes a series of operations on the print heads, such as suction, wiping and preliminary ejection, just before the automatic dot adjust value calculation processing is initiated. This stabilizes the ejection performance of the print heads, so the test patterns can be printed in a stable condition allowing for more reliable dot adjust value calculation processing.

Although the recovery operation is described here to involve a series of operations, such as suction, wiping and preliminary ejection, step 1 operation is not limited to these operations. For example, the recovery operation may include only preliminary ejections or only preliminary ejections and wiping in order to minimize the amount of ink spent during this mode. In that case, it is preferred that the number of preliminary ejections be set higher than when a normal printing is done.

Whether the suction operation in the recovery operation of step 1 should be executed or not may be determined according to a time that has passed from a previous suction operation. In this case, it is first checked whether a predetermined time has elapsed from the previous suction operation and, if the predetermined time is not exceeded, the processing moves to step 2 where it executes the automatic dot adjust value calculation processing. If the time that has elapsed from the previous suction operation exceeds the predetermined period, a series of recovery operations including the suction operation is performed, after which the processing proceeds to step 2.

Further, whether the suction operation in step 1 should be executed or not may be determined according to the number of ejections from each print head counted from the previous suction operation. In this case, only when the number of ejections becomes larger than a predetermined value, the suction operation in step 1 permitted to be executed. It is also possible to determine the execution of the recovery operation based on both the elapsed time and the number of ejections.

By applying a variety of conditions in this way, an execution of too many suction operations can be prevented, which in turn avoids wasteful consumption of ink while the automatic dot adjust value calculation processing is carried out efficiently. Further, in this embodiment there is no limitation on the number of operations and the execution order of suction, wiping and preliminary ejection. These can be set appropriately according to the conditions of use.

In subsequent step 2 an LED as an optical sensor is calibrated. Here, the amount of current applied is adjusted to ensure that the output characteristic of the optical sensor is linear with respect to the density of an image being read. More specifically, the amount of current to be applied is controlled stepwise, for example, at 5% intervals from a full energization of 100% duty down to a 5% duty. Based on measurements, an optimum current duty is determined. In the adjustment procedure performed in subsequent steps, the optical sensor is driven by applying the current value obtained here.

Next, at step 3 a coarse adjustment for the bidirectional printing is performed. That is, the landing positions are somewhat roughly adjusted between dots formed in the forward scan and dots formed in the backward scan. The printing apparatus of this embodiment is assumed to have a precision tolerance of relative dot landing position of ±4 dots in the bidirectional printing.

Figure 5:
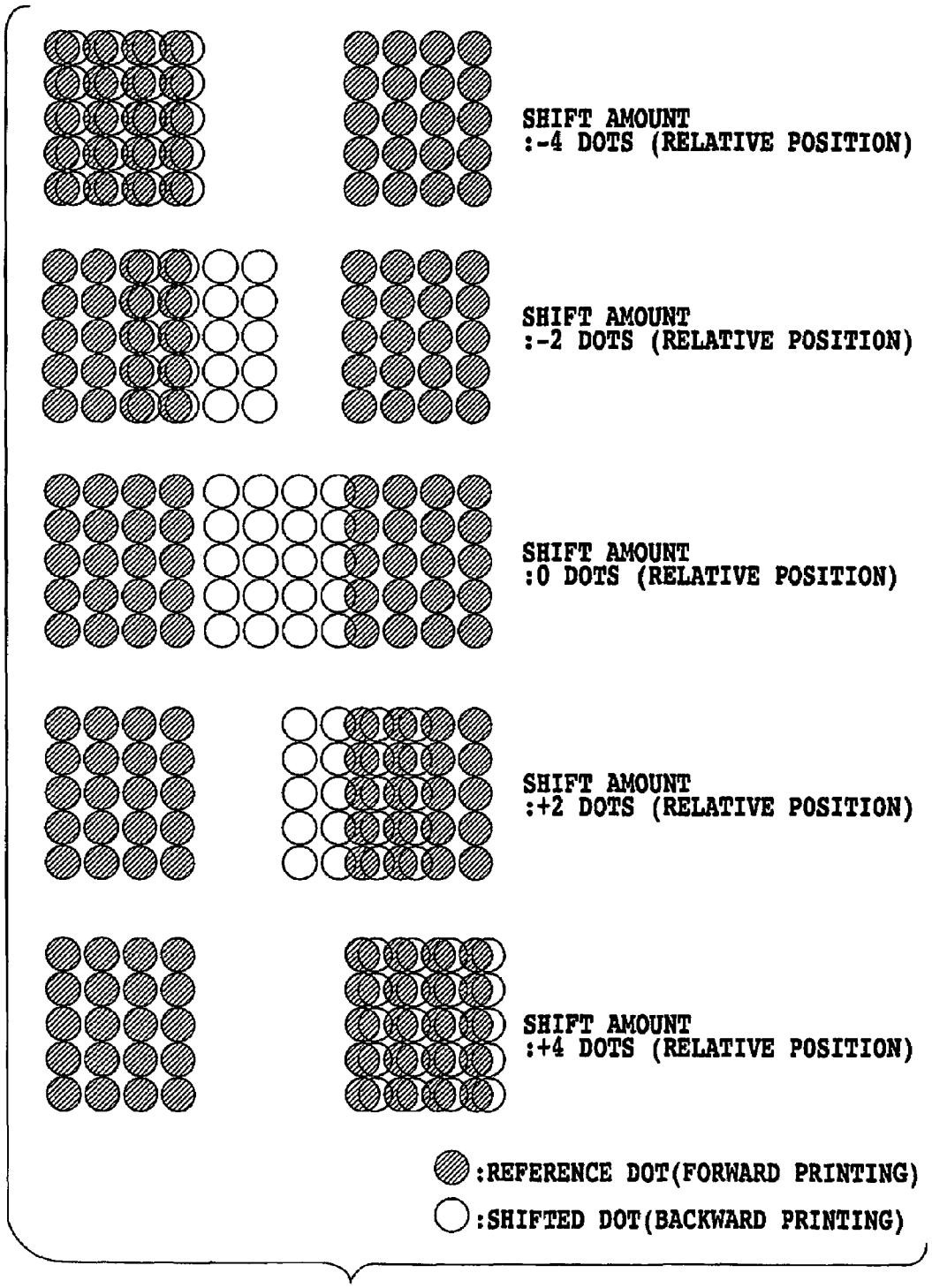
FIG. 5 illustrates an example of test patterns for coarse adjustment.

FIG. 5 shows an example of test patterns for coarse adjustment printed by the print heads at step 3. In the figure, black dots are formed in the forward scan and taken as reference dots and blank dots are formed in the backward scan and taken as shifted dots. The shifted dots are shifted in their print positions by two dots at a time from the reference dots and printed at five shifted positions. If no adjustment is applied, that is, the amount of shift is 0 dot, any deviation or misalignment that occurs in this adjustment state is a misalignment that is caused by variations in the manufacture of the printing apparatus and the print heads. Although this state in FIG. 5 represents the least amount of misalignment between the reference dots and the shifted dots, in a printing apparatus with a precision tolerance of ±4 dots the amount of misalignment can vary in a range illustrated by five shifted positions of FIG. 5. Therefore in this embodiment, patterns with shifts of −4 dots to +4 dots are printed and their optical densities are measured. In measuring the optical density of each pattern, the aforementioned optical sensor mounted on the carriage 2 is used.

Figure 6:
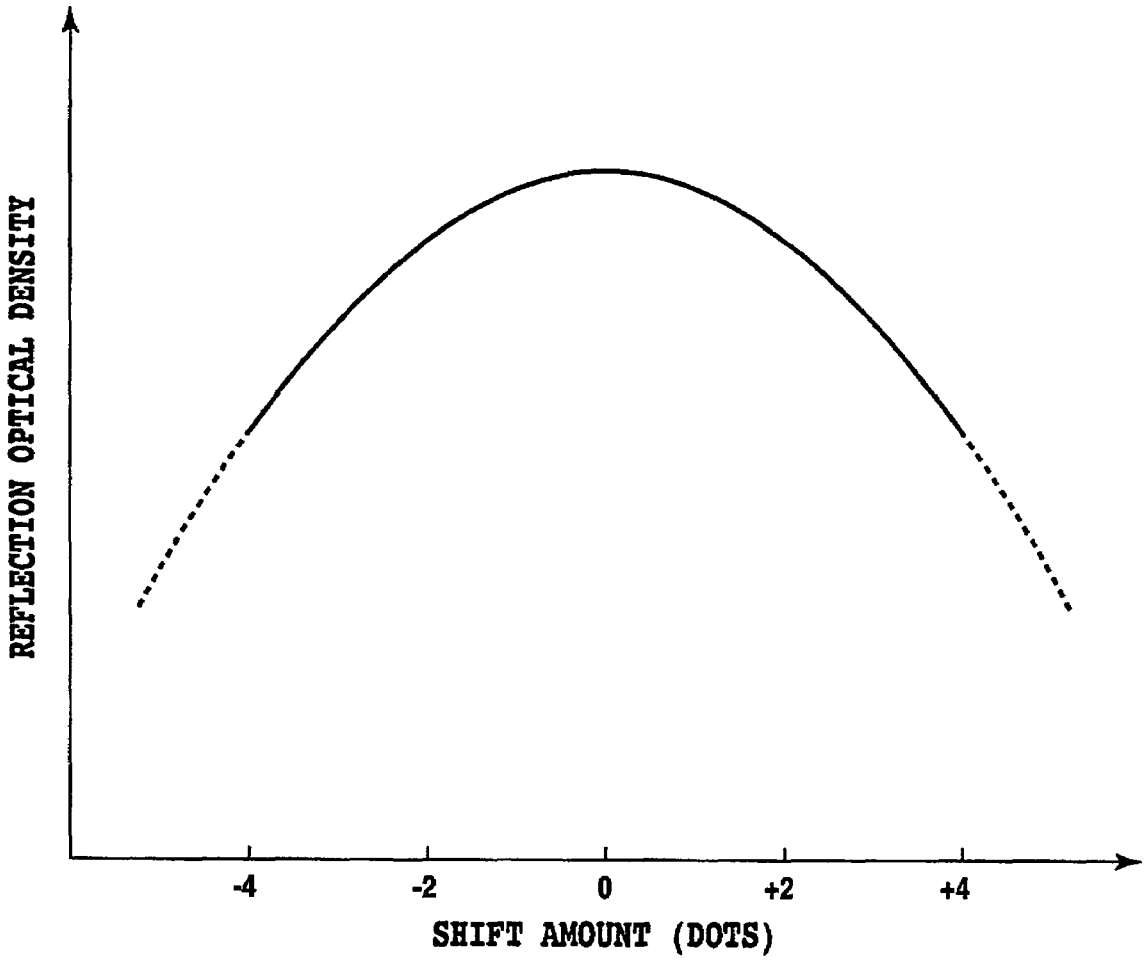
FIG. 6 is a graph showing an output characteristic of an optical sensor when it reads the test patterns.

FIG. 6 shows an output characteristic of the optical sensor when it reads the test patterns of FIG. 5. More specifically, the optical sensor radiates light onto the patterns, receives reflected light and A/D-converts an intensity of the received light into a digital value for each pattern. Here, the relation between the amount of shift and the output value for each pattern is approximated by a polynomial and a resulting curve is shown by a dashed line. Approximated values on the dashed line for amount of shift of each pattern are connected by a solid line. With the approximated characteristic obtained in this way, it is possible to estimate the amount of shift for a point where the reflected density is maximum. In this embodiment, the adjust value can be set at a one-dot pitch which is narrower than the interval of the shift shown in FIG. 5. Hence, an integer closest to the value obtained from the approximation curve is used as an adjust value for a backward scan in the bidirectional printing. After this coarse adjustment is finished, the processing moves to step 4 where a fine adjustment is made with a finer precision for the bidirectional printing.

Figure 7:
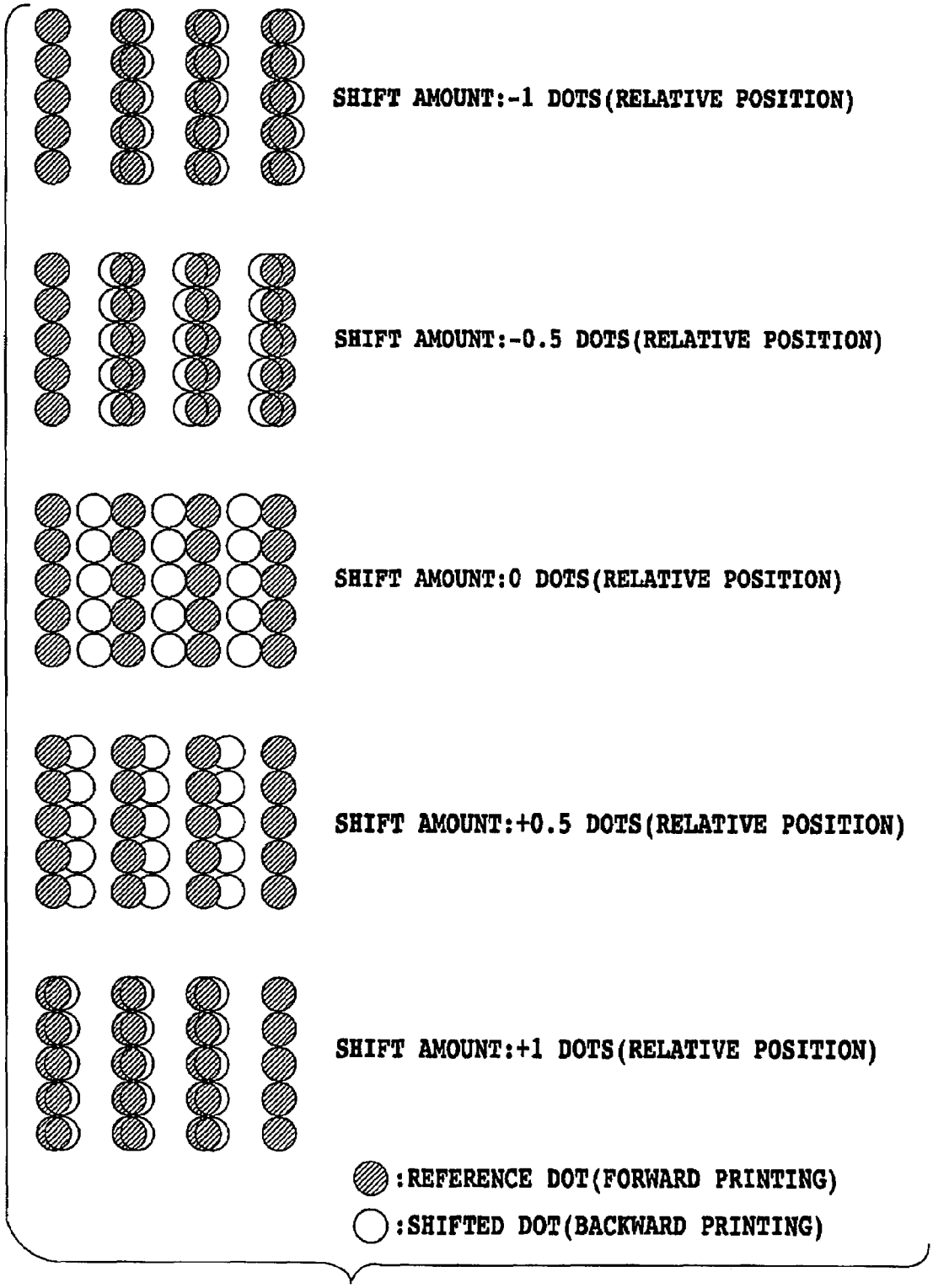
FIG. 7 illustrates an example of test patterns for fine adjustment.

FIG. 7 shows one example of test patterns for fine adjustment printed by the print heads in step 4. As in the case of FIG. 5, black dots are formed in the forward scan and taken as reference dots and blank dots are formed in the backward scan and taken as shifted dots. The shifted dots are shifted in their print positions by 0.5 dot at a time from the reference dots and printed at five shifted positions. If no adjustment is applied, that is, the amount of shift shown in FIG. 7 is 0 dot, any deviation or misalignment that occurs in this adjustment state is a misalignment still remaining after the coarse adjustment. In FIG. 7, this state with the amount of shift of 0 dot represents the least amount of misalignment between the reference dots and the shifted dots. However, since this is a fine adjustment after the one-dot coarse adjustment, the amount of misalignment can vary in a range of −1 dot to +1 dot. Therefore in the fine adjustment of this embodiment, patterns are printed by changing the shift amount stepwise in this misalignment range.

In measuring an optical density of each pattern, the optical sensor mounted on the carriage 2 is used, as in the coarse adjustment. As in the case of the coarse adjustment, the output characteristic of the optical sensor for each shift amount is approximated by a polynomial to determine an approximation curve. From this approximation curve, a point with the maximum reflection density can be estimated. In this embodiment although the patterns for fine adjustment are shown at 0.5-dot pitches, a final dot adjustment can be made at smaller pitches. Thus, among adjustable values available in the printing apparatus, the one closest to the value obtained from the approximation curve can be set as a final adjust value for the backward scan in the bidirectional printing.

A series of steps performed in step 3 and step 4 for the coarse and fine adjustments has been described. In this embodiment the number of printed patterns, the shift amount and the adjustment precision are not limited to those of the above example.

For example, in the process of coarse adjustment, rather than performing the detailed approximation as shown in FIG. 6, it is possible to select from among a plurality of 2-dot pitch patterns one with the maximum reflection density value and to use the shift amount of the selected pattern as the adjust value for the coarse adjustment. In that case, the fine adjustment patterns need to be printed in a shift range of −2 dots to +2 dots. Conversely, the coarse adjustment may be made at a finer pitch than the one-dot pitch. In that case, the fine adjustment may reduce the number of patterns to be printed or print the patterns at finer shift intervals. Further, if a final required adjustment precision is equal to a shift interval used in the fine adjustment, the shift amount representing the maximum reflection density value can be used as an adjust value for the bidirectional printing without performing the approximation.

Whichever case is adopted, the only requirement is that a balanced, smooth coordination in terms of the number of patterns, the shift pitch and the adjustment precision is established between the coarse adjustment in step 3 and the fine adjustment in step 4.

Referring to FIG. 4 again, step 5 prints a confirmation pattern using the adjust value obtained. With the confirmation pattern printed, the user can now know that he has successfully completed the dot adjust value calculation processing and recognize a result of the dot adjust value calculation processing. The confirmation pattern is output by printing line patterns or the like, that are easily checked by the user, in the bidirectional printing using the final adjust value determined by step 3 and step 4. If there is a plurality mode of bidirectional printing corresponding to different carriage speeds, confirmation patterns may be printed for each carriage speed. In the automatic dot adjust value calculation processing, therefore, two kinds of patterns, adjust patterns for measuring densities for adjustment and confirmation patterns for confirming the adjustment made, are output.

After the adjust value confirmation patterns have been printed and checked by the user in step 5, the processing proceeds to step 6 where CPU 101 stores the adjust value obtained in the memory of the printing apparatus. In this embodiment each time the automatic dot adjust value calculation processing is executed, the adjust value obtained is written over the previous value in the memory. Now, the automatic dot adjust value calculation processing is completed. When an ordinary printing is performed next time, the adjust value stored in step 6 is read out and a correction is made based on the adjust value.

As described above, in the automatic dot adjust value calculation processing of this embodiment, not only can a series of steps be executed automatically but they can also be performed with high precision in a precision tolerance range by using a two-step adjustment method involving coarse and fine adjustments. Performing two adjustments with different precisions successively can narrow down a range of the final fine adjustment in advance, improving a throughput of the entire sequence. Further, since a series of steps are executed automatically, no user judgment is invoked during the process as it is in the manual dot adjust value calculation processing, thus preventing erroneous operations due to misjudgment.

In the above explanation of the automatic dot adjust value calculation processing, we have described a process of correcting landing position misalignments in the bidirectional printing for the sake of simplicity. However, as already described, the printing apparatus of this invention can also perform other dot adjust value calculation processing at the same time. For example, each of the print heads applied in this embodiment has a plurality of nozzle columns for one color ink and can also perform the dot adjust value calculation processing to adjust landing positions of dots ejected from individual nozzle columns. Further, another dot adjust value calculation processing is also performed simultaneously to adjust landing positions of dots ejected from a plurality of print heads of different color inks. This embodiment can even cope with a situation, in which one and the same print head has a plurality of nozzle columns ejecting different color inks or different amounts of ink.

For these dot adjust value calculation processing with different purposes too, test patterns can be printed on the same print medium and their densities read by the same optical sensor in the step 3 and step 4 of FIG. 4 simultaneously with the dot adjust value calculation processing for bidirectional printing.

Whatever purpose the dot adjust value calculation processing may have, the first printing to form reference dots and the second printing to form shifted dots by shifting them a predetermined pitch at a time from the reference dots are performed sharingly by two printing means to be adjusted. This enables the final adjust value to be determined in a process similar to that for the adjustment of the bidirectional printing. For example, when landing positions of dots ejected from two nozzle columns are adjusted, the first printing is done by one of the two nozzle columns and the second printing by the other. Further, when the dot landing position adjustment is made among a plurality of print heads that eject different color inks, the first printing is done, for example, by a black print head and the second printing by a cyan head. This enables an adjustment to be made between black and cyan heads. Then, by performing the similar adjustments between black and magenta heads and between black and yellow heads, all colors can be adjusted relative to black, which at the same time corrects misalignments among different colors.

The number of test patterns, the shift pitch and the adjustment accuracy are individually set according to the purpose of the dot adjust value calculation processing to be performed. Depending on the purpose of the dot adjust value calculation processing, both of the coarse and fine adjustments may not have to be performed and only one of them may be executed.

Further, when the automatic dot adjust value calculation processing is executed next time, only the fine adjustment may be performed, while the test patterns may be printed such that the adjust value obtained in the previous processing comes at the center of the test patterns (in FIG. 5, at a position corresponding to the shift amount of 0 dot) and the adjustable range may be shifted accordingly. Generally, once the dot adjust value calculation processing has been carried out, the alignment will hardly shift largely unless the print head is replaced. In this embodiment, each time the automatic dot adjust value calculation processing is performed, an adjust value obtained is written over the previous value in memory. Thus, when the next adjustment is made, only a fine adjustment needs to be executed in a narrow adjustment range centering on the adjust value obtained just before. This arrangement can reduce the number of patterns printed for the dot adjust value calculation processing and also the time it takes to execute the dot adjust value calculation processing. This is particularly useful for a user who wants a simple adjustment.

In the automatic dot adjust value calculation processing, it is preferred that an ink color with an excellent light absorbing characteristic for an LED color be used to print test patterns. That is, since the printing apparatus of this embodiment uses a red or infrared LED as an optical sensor, a test pattern printed with black or cyan ink can produce a density characteristic and S/N ratio with a best sensitivity, considering their light absorbing characteristic for red or infrared light. Therefore, in the adjustment process for the bidirectional printing of this embodiment, the test patterns are printed with black or cyan.

The use of red or infrared LED as the optical sensor does not limit this invention in any way. For example, a blue LED and a green LED may be mounted in addition to the red LED, so that the density characteristic and S/N ratio can be obtained with good sensitivity for all colors of light. This allows the print positions to be adjusted among all colors with high accuracy.

Next, the "detailed dot adjust value calculation mode" in the printing apparatus of this embodiment will be explained. The "detailed dot adjust value calculation mode" is intended to execute the dot adjust value calculation processing with still higher accuracy and reliability. For this purpose, this mode has a greater number of test patterns to be output than that of the "simple dot adjust value calculation mode" and requires some cumbersome steps on the part of the user. However, this mode offers a satisfactory adjustment for a user seeking higher image quality.

This detailed dot adjust value calculation mode may suitably use the manual dot adjust value calculation processing. The automatic dot adjust value calculation processing is an open loop control dependent on the result of detection by the optical sensor and is performed in the presence of a variety of error factors, including an environment in which the test patterns are printed and conditions of the printing apparatus, print head and optical sensor. Thus, the automatic dot adjust value calculation processing is not so suited to a truly strict adjustment. The manual dot adjust value calculation processing, on the other hand, is executed one step at a time according to a judgment of the user. Thus, an adjustment can be made even under a condition involving error factors and still a reliable result can be obtained.

Figure 8:
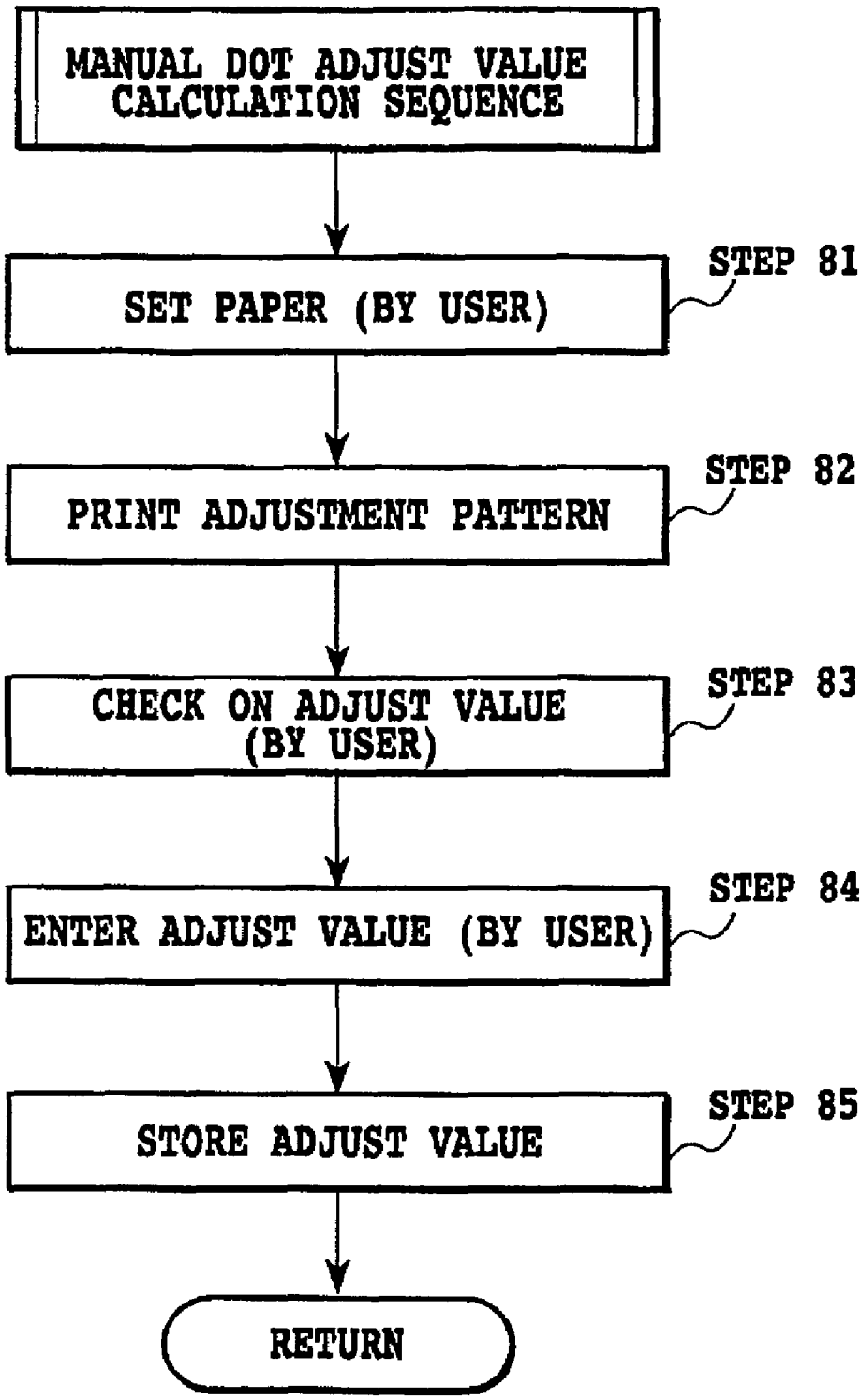
FIG. 8 is a flow chart showing a sequence of steps performed by CPU or the user in the manual dot adjust value calculation processing used in the embodiment of this invention.

FIG. 8 is a flow chart showing a series of steps performed by CPU 101 and the user in the manual dot adjust value calculation processing of this embodiment. For the sake of simplicity, we will explain about a process of performing the dot adjust value calculation processing only for the bidirectional printing.

In FIG. 8, when the manual dot adjust value calculation processing is initiated, at step 81 the user sets a print medium on the printing apparatus and gives an instruction, as from a menu in a printer driver, to start printing test patterns.

Figure 9:
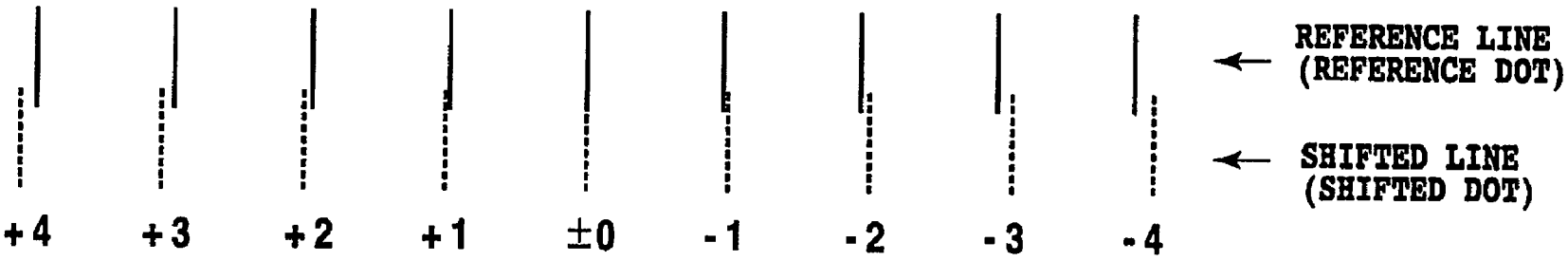
FIG. 9 illustrates an example of adjust patterns in the manual dot adjust value calculation processing used in the embodiment of this invention.

After the print start command is entered, the processing moves to step 82 where CPU 101 causes the apparatus to print test patterns. The test patterns printed here may be ones whose reflection optical density changes according to a dot landing position, such as shown in FIG. 5 or line patterns shown in FIG. 9. In FIG. 5 4-dot-wide block patterns are printed in forward and backward scan alternately. The width of each block pattern is preferably adjusted to more than that estimated from the precision of the printing apparatus. A block pattern of a predetermined width is printed in a forward scan and another block pattern of the same width is printed in a backward scan, shifted by an adjustable pitch. This bidirectional printing is repeated by successively shifting block patterns in the backward scans to print a plurality of patterns. This process enables the user to make a judgment with the same level of precision as that with which landing positions can be adjusted.

Whichever pattern is applied, if the mode is set to the "detailed dot adjust value calculation mode," it is preferred that the shift pitch for each pattern be set almost as fine as the adjustable pitch in which the printing apparatus can be adjusted. Thus, the number of test patterns to be output and the printing time are greater than those of the "simple dot adjust value calculation mode."

In next step 83 the user checks the printed test patterns and determines an appropriate adjust value. If the test patterns printed in step 82 are such as shown in FIG. 5, the user need only select an adjust value of a pattern that looks most uniform. In the case of line patterns shown in FIG. 9, an adjust value of a line pattern with the best straightness should be chosen.

As described above, the same test patterns can be used in both the automatic dot adjust value calculation processing and the manual dot adjust value calculation processing. The obvious difference between them is whether the subsequent decision relies on the optical sensor or the observation by the user.

In step 84 the user enters the selected adjust value from a menu of a printer driver. Upon receiving the adjust value, the CPU 101 stores it in memory such as RAM 105 (step 85). An area to store the adjust value in this manual dot adjust value calculation processing differs from that used in the automatic dot adjust value calculation processing. With the adjust value stored, the manual dot adjust value calculation processing is completed.

The manual dot adjust value calculation processing is a method of making adjustments based on the user's own observation and decision and the reliability of this adjustment depends on user's judgment. Thus, for a novice user the manual processing may be difficult and uncertain. But for a user accustomed to printing apparatus, the manual processing is easy to handle and even a reliable and highly accurate method.

In the automatic dot adjust value calculation processing that uses an optical sensor, there may be ink colors for which the dot adjustment is difficult to perform depending on the color of a sensor light, allowing adjustment for only a limited range of colors. Although a plurality of sensors may be provided in order to cope with all ink colors, as described above, this will make the printing apparatus expensive. The manual dot adjust value calculation processing, on the other hand, has no such a problem and thus is able to perform adjustment reliably on almost all colors.

In the above explanation of the manual dot adjust value calculation processing, an example case of correcting the dot landing position misalignment between the forward and backward scans in the bidirectional printing has been described for the sake of simplicity. As in the case of the automatic dot adjust value calculation processing, the printing apparatus of this embodiment can also perform dot adjust value calculation processing of other purposes simultaneously with the manual dot adjust value calculation processing. For the dot adjust value calculation processing with different purposes, a plurality of test patterns can be printed simultaneously with those test patterns for the bidirectional printing dot adjust value calculation processing. Checking multiple kinds of test patterns printed on the same print medium or on a plurality of print mediums output at one time, the user can make decision of the adjust value.

The number of test patterns, the shift pitch and the adjustment precision can be set individually according to the purposes of the individual dot adjust value calculation processing.

When the manual dot adjust value calculation processing is initiated next time, the test patterns may be printed such that the adjust value obtained in the previous processing comes at the center of the test patterns (in FIG. 5, at a position corresponding to the shift amount of 0 dot) and the adjustable range may be shifted accordingly. In this embodiment, each time the manual dot adjust value calculation processing is performed, an adjust value obtained is written over the previous value in a memory area different from the one used for the automatic dot adjust value calculation processing. Thus, when the next adjustment is made by the manual dot adjust value calculation processing, only a fine adjustment needs to be executed in a narrow adjustment range centered on the previous adjust value. This arrangement allows for reductions in the number of patterns printed for the dot adjust value calculation processing and in the time taken by the processing.

As described above, this embodiment is characterized in that two independent modes are provided—a "detailed dot adjust value calculation mode" which prints test patterns with a higher precision (at a finer shift pitch) and permits manual setting of an adjust value and a "simple dot adjust value calculation mode" which allows for simple and automatic adjustment though with not so high a precision—and that these two modes are selectively invoked as appropriate.

If the automatic dot adjust value calculation processing is intended for the "simple dot adjust value calculation mode," there is no need to process all the adjust items by the automatic dot adjust value calculation processing. The automatic dot adjust value calculation processing may be performed only on the minimum required adjustment items for maintaining an image quality, such as the bidirectional printing adjustment. In the manual dot adjust value calculation processing, on the other hand, all the adjustment items may be covered, thus offering a full adjustment capability to the user who would not be satisfied with the automatic dot adjust value calculation processing.

Conversely, it is also possible to use the manual dot adjust value calculation processing for a coarse adjustment in a wider range in order to make a preliminary adjustment to narrow down a range for the subsequent automatic dot adjust value calculation processing. In that case, during the manual dot adjust value calculation processing, a coarse adjustment is done visually in a predetermined fixed range; and during the automatic dot adjust value calculation processing, a fine adjustment using an optical sensor is made in a limited range centered on the adjust value determined by the manual dot adjust value calculation processing. This procedure makes it possible to complete the adjustment sequence in a shorter length of time than when the entire sequence is executed by the manual dot adjust value calculation processing and to provide higher reliability than when the entire sequence is executed by the automatic dot adjust value calculation processing.

As disclosed in Japanese Patent Laid-open No. 11-291470, the manual dot adjust value calculation processing can also be used as an alternative means if the adjustment sequence fails to be completed by the automatic dot adjust value calculation processing. The optical sensor which is influenced by external light may undesirably operates. When a usable range of the optical sensor is apparently narrow during the calibration of the optical sensor or when a reflected light becomes extremely intensified during the automatic dot adjust value calculation processing, it is decided that an error has occurred due to influences of external light and the automatic dot adjust value calculation processing can be halted. Then, an error status is communicated to the host computer which in turn displays the error through application and at the same time prompts the user to initiate the manual dot adjust value calculation processing. Alternatively, when the calibration error is detected, it is possible to stop the automatic dot adjust value calculation processing and print a message on a fed print medium prompting the user to execute the manual dot adjust value calculation processing.

As described above, in this invention the two dot adjust value calculation methods need to be able to be invoked as necessary. A feature most characteristic of the printing apparatus of this embodiment is that the user can choose a desired one from two or more dot adjust value calculation processing.

Figure 10:
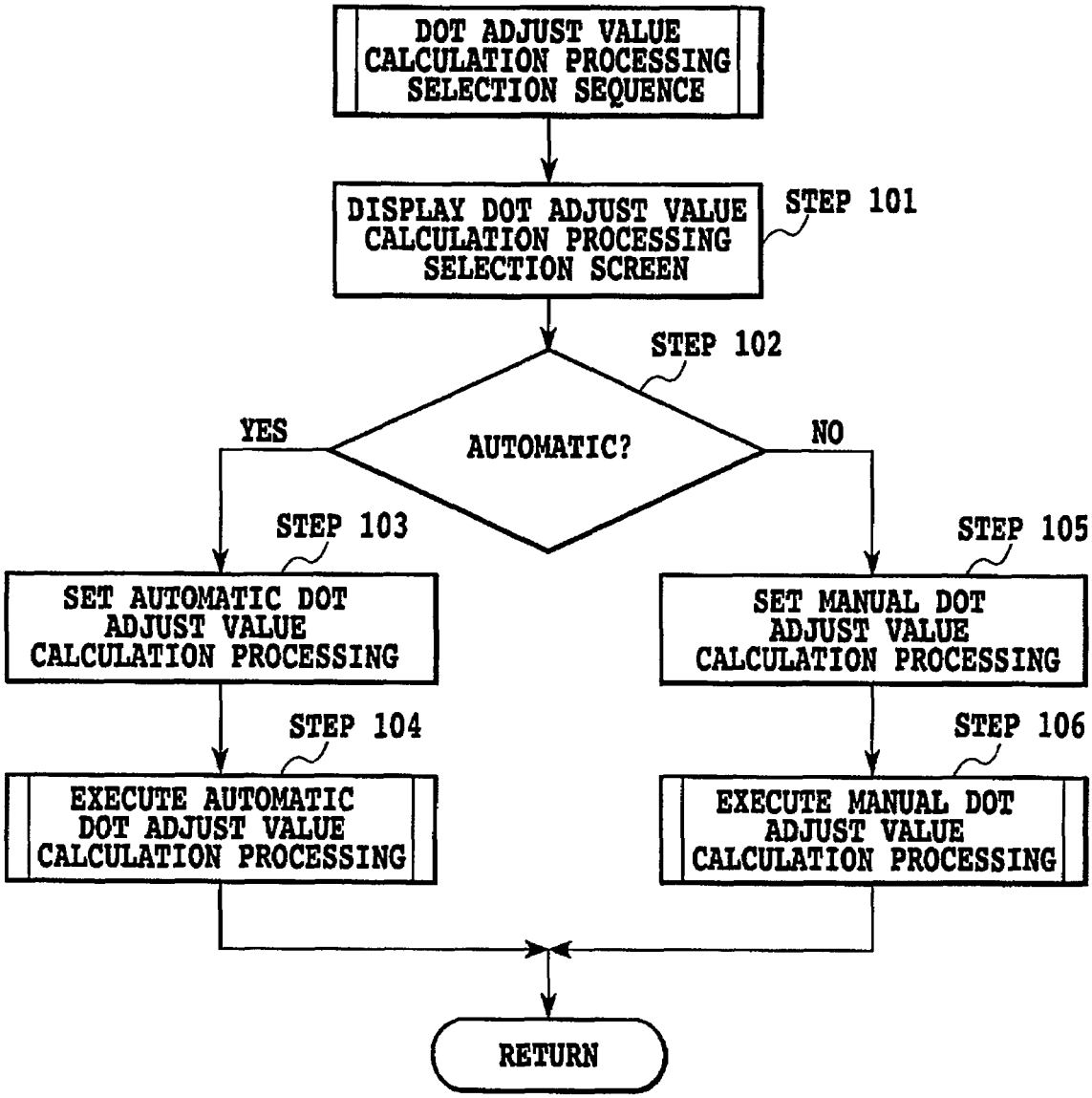
FIG. 10 is a flow chart showing a sequence of steps performed in selecting between an automatic and a manual dot adjust value calculation processing.

FIG. 10 is a flow chart showing a dot adjust value calculation processing selection sequence which allows the user to choose from the two dot adjust value calculation methods. First at step 101, a printer driver in the host device displays a dot adjust value calculation method selection screen.

Figure 11:
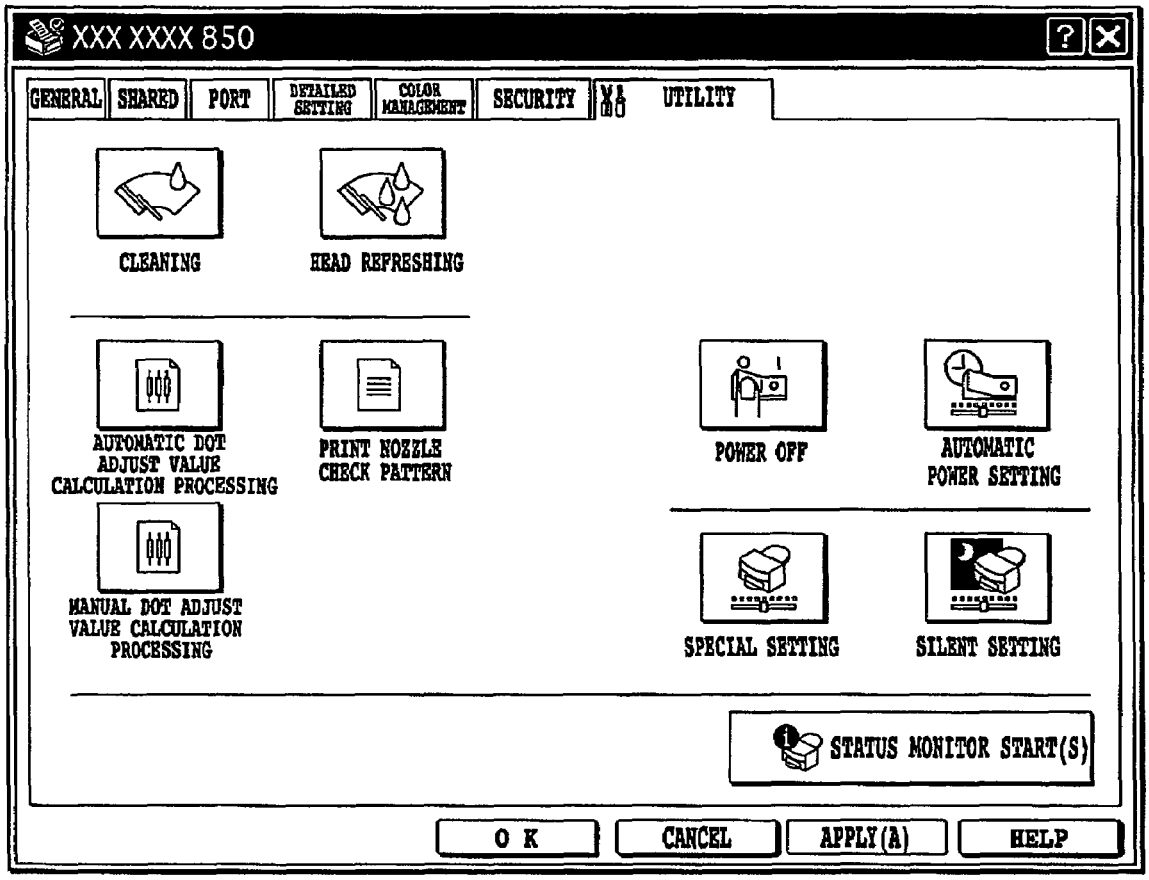
FIG. 11 illustrates an example screen of a printer driver utility.

FIG. 11 shows an example screen of the printer driver utility that is displayed at step 101. In this figure an "automatic head position adjustment" that performs the automatic dot adjust value calculation processing and a "manual head position adjustment" that performs the manual dot adjust value calculation processing are shown side by side. With the two methods displayed using icons and letters in this way, the user can understand their difference well. Looking at this screen, the user clicks on the desired one of the dot adjust value calculation processing. The configuration that allows visual recognition and selection of objects is easy to understand. More preferably, it is possible, when respective menus are chosen, to display a brief explanatory comment on the feature of each adjustment method selected.

When the selection of processing is made by the user, the printer driver checks if the selected dot adjust value calculation processing is the automatic dot adjust value calculation processing (step 102).

If at step 102 it is decided that the automatic dot adjust value calculation processing has been selected, the printer driver moves to step 103 where it makes setting to cause the printing apparatus to perform the automatic dot adjust value calculation processing.

Upon receiving an instruction to execute the automatic dot adjust value calculation processing, CPU 101 initiates the automatic dot adjust value calculation sequence described above (step 104).

On the other hand, if at step 102 it is decided that the automatic dot adjust value calculation processing has not been selected, the printer driver moves to step 105 where it makes setting to cause the printing apparatus to perform the manual dot adjust value calculation processing.

Upon receiving an instruction to execute the manual dot adjust value calculation processing, CPU 101 initiates the manual dot adjust value calculation sequence described above (step 106). Now, the dot adjust value calculation processing selection sequence is completed.

As described above, the printing apparatus of this embodiment provides a plurality of methods for calculating dot adjust values to adjust the print positions of dots and also allows the user to select a desired dot adjust value calculation method according to the user requirement or the quality of an image to be printed. Therefore, increasingly diversified user needs of recent years can be dealt with by the dot adjust value calculation processing of this invention.

Although the automatic dot adjust value calculation processing has been described to be applied to the "simple dot adjust value calculation mode" and the manual dot adjust value calculation processing to the "detailed dot adjust value calculation mode," the present invention is not limited to this configuration. Whether the dot adjust value calculation processing is performed in a simple manner or detailed manner, or automatically or manually, the most characteristic feature of this invention is the configuration that allows the user to select from among a plurality of dot adjust value calculation processing provided in the printing apparatus.

For example, Japanese Patent Application Laid-open No. 11-291470 cited in the Background of the Invention section discloses a printing apparatus that has manual dot adjust value calculation processing and automatic dot adjust value calculation processing and which can selectively activate one of the dot adjust value calculation processing, as necessary. It is noted, however, that this selection is made automatically by the printing system and the configuration of the cited reference differs from that of this invention in which the user himself selects the desired dot adjust value calculation processing. As already described, in Japanese Patent Application Laid-open No. 11-291470, even if the user feels that the automatic dot adjust value calculation processing is not performing an accurate print position control due to some external disturbance factors, the print position adjustment continues as is in the automatic mode unless an error is detected automatically. On the contrary, if the user is given the ability to select, as in this invention, the user can switch to the manual dot adjust value calculation processing whenever he or she suspects something is wrong even if the automatic dot adjust value calculation processing has finished normally. Therefore, this invention provides the user with a more reliable adjustment.

Further, since adjust values obtained by a plurality of dot adjust value calculation processing are stored in different memory locations, if one of the dot adjust value calculation processing fails and an inappropriate adjust value is stored, another adjust value produced and stored by the other dot adjust value calculation processing can be used to produce a normal quality image. For example, if the automatic dot adjust value calculation processing is completed normally but the user is not satisfied with the result, an adjust value of the previous manual dot adjust value calculation processing, which is safely stored, can be used for adjustment.

(Others)

This invention is particularly advantageously applied to a print head and a printing apparatus which, as one type of an ink jet printing system, have a means to generate thermal energy (e.g., electrothermal transducers and a laser light) and causes a status change in ink by the thermal energy to eject ink. When applied to this type of ink jet printing system, this invention can realize higher print resolution.

As for a representative construction and a working principle of this type of ink jet printing system, those disclosed in U.S. Pat. Nos. 4,723,129 and 4,740,796 may preferably be used.

This system can be applied to the so-called on-demand type and continuous type. In the case of the on-demand type, for which this system is particularly advantageous, a plurality of electro-thermal transducers arranged to match the associated ink-holding sheets and liquid paths are applied at least one drive signal corresponding to print information to generate thermal energy that causes a rapid temperature rise in ink, thereby producing a film boiling on a heat acting surface of the print head and forming a bubble in ink that matches the drive signal in one-to-one correspondence. The growth and contraction of the bubble expels ink from a nozzle to form at least one flying droplet. If the drive signal is shaped in a pulse form, a bubble can be expanded and contracted instantly and appropriately, realizing a particularly responsive ejection of ink. The pulse-shaped drive signal may suitably be generated as disclosed in U.S. Pat. Nos. 4,463,359 and 4,345,262. A further improved printing can be assured by adopting those conditions on the temperature rise rate of the heat acting surface disclosed in U.S. Pat. No. 4,313,124.

As for the construction of a print head, a combined construction of nozzles, liquid paths and electro-thermal transducers (linear ink paths or angled ink paths), such as disclosed in the above patent specifications, may be employed. Another construction, in which the heat acting portion is arranged in a bent area, as disclosed in U.S. Pat. Nos. 4,558,333 and 4,459,600, is also covered by this invention. Furthermore, this invention is also effectively applied to a construction in which, for a plurality of electro-thermal transducers, a common slit is provided as an ink ejection portion, as disclosed in Japanese Patent Application Laid-open No. 59-123670 and also to a construction in which openings to absorb a pressure wave of thermal energy are used as an ink ejection portion, as disclosed in Japanese Patent Application Laid-open No. 59-138461. With this invention, therefore, printing can be performed reliably and efficiently, whatever configuration of the print head.

Further, this invention can also be applied effectively to a full-line type print head equal in length to a maximum printable width of a print medium. Such a print head may be formed by combining two or more print heads to have the total required length or by using a single, integrally formed print head.

Among the serial type print heads to which this invention is effectively applied are fixed type print head which is secured to a printing apparatus body, a replaceable chip type print head which, when mounted on the printing apparatus body, can make an electric connection with the apparatus body or can be supplied ink from the apparatus body, and a cartridge type print head that has an ink tank integrally mounted on the print head.

The applicable print heads can vary in kind and number. For example, only one print head may be mounted in the printing apparatus for a single color ink, or a plurality of print heads may be mounted for different ink colors and densities. Further, this invention is very effectively applied to a printing apparatus that has at least one of two print modes—a multicolor mode using different color inks and a full color mode forming a variety of colors by mixing primary colors. In this case too, the printing apparatus may use a single, integrally mounted print head or two or more print heads.

While ink has been described as a liquid, it is possible to use an ink that solidifies below room temperature and softens or liquefies at room temperature. Because it is common practice in the ink jet system to temperature-control the ink in a range of between 30° C. and 70° C. to keep the ink viscosity in a stable ejection range, an ink may be used which becomes liquefied when applied a print signal. Further, to positively prevent an ink temperature rise or ink evaporation due to thermal energy by using the thermal energy to cause a status change in ink from solid to liquid, it is possible to use an ink that solidifies on standing and liquefies on heating. In other words, this invention is also applicable to a case where an ink used becomes liquefied only when applied thermal energy. Examples of such inks include an ink which is liquefied by the application of thermal energy in response to the print signal before being ejected and an ink that starts solidifying before it arrives at a print medium. These inks may be arranged as described in Japanese Patent Application Laid-open Nos. 54-56847 and 60-71260, in which the liquid or solid ink is held in recesses or through-holes in a porous sheet and is opposed to the electro-thermal transducers. The printing system of this invention that is most suited to these inks is one that implements the film boiling method.

The ink jet printing system of this invention may be implemented in the form of an image output terminal for information processing devices such as computers and also in the form of a copying machine combined with a reader and of a facsimile machine having a transmission/reception function.

As described above, since this invention allows the user to selectively execute desired dot adjust value calculation processing as necessary, an appropriate dot adjust value calculation processing can be executed according to the user requirements and the quality of an image to be printed. This invention therefore can deal with diversified user needs.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2003-314427 filed Sep. 5, 2003, which is hereby incorporated by reference herein.

What is claimed is:

1. An adjustment method of print positions for a printing apparatus that uses print heads and forms an image on a print medium by a first printing and a second printing with different printing conditions, comprising the steps of:

preparing multiple kinds of dot adjust value obtaining processes capable of determining an adjust value for aligning print positions of dots formed by the first and second printings, the multiple kinds of dot adjust value obtaining processes including an automatic process for determining the adjust value based on an output of an optical sensor reading test patterns printed by means of the print heads and a manual process for determining the adjust value based on information entered by a user;

accepting one process selected by the user from the multiple kinds of dot adjust value obtaining processes; and performing respective test pattern printing by the first printing and the second printing that correspond to the selected dot adjust value obtaining process and determination of the adjust value by the selected dot adjust value obtaining process, wherein the automatic process and the manual process differ from each other in test patterns printed by the first printing and the second printing, and an adjusting precision for the positions of dots formed in the first printing and the second printing based on the adjust value determined by the manual processing is higher than that by the automatic processing.

2. A method according to claim 1, wherein each of the multiple kinds of dot adjust value obtaining processes has a step of printing a plurality of test patterns with the adjust value differentiated in a predetermined range among the dot adjust value obtaining process, and wherein at least one of the multiple kinds of dot adjust value obtaining processes has the predetermined range different from that of another dot adjust value obtaining process.

3. A method according to claim 1, wherein at least one of the multiple kinds of dot adjust value obtaining processes has a kind of the printing condition different from that of another dot adjust value obtaining process.

4. A method according to claim 1, wherein each of the multiple kinds of dot adjust value obtaining processes has a step of printing a plurality of test patterns and a decision step of determining the adjust value from the test patterns, and wherein, among the multiple kinds of dot adjust value obtaining processes, those with a higher level of ease of operation for a user automatically determines the adjust value using a sensor in the decision step and those with a lower level of ease of operation for a user determines the adjust value by user's judgment through a visual check in the decision step.

5. A method according to claim 1, wherein each of the multiple kinds of dot adjust value obtaining processes has a step of storing the acquired adjust value in an independent area.

6. A method according to claim 1, wherein at least one of the multiple kinds of dot adjust value obtaining processes is executed before another dot adjust value obtaining process as a pre-executed processing.

7. A method according to claim 6, wherein, with the adjust value acquired by the pre-executed processing used as a reference, the other dot adjust value obtaining process is executed.

8. A printing system which uses print heads to form an image on a print medium by a first printing and a second printing with different printing conditions, the printing system comprising:

means for enabling multiple kinds of dot adjust value obtaining processes capable of determining an adjust value for aligning print positions of dots formed by the first and second printings, the multiple kinds of dot adjust value obtaining processes including an automatic process for determining the adjust value based on an output of an optical sensor reading test patterns printed by means of the print heads and a manual process for determining the adjust value based on information entered by a user;

means for accepting one process selected by the user from among the multiple kinds of dot adjust value obtaining processes; and means for performing respective test pattern printing by the first printing and the second printing that correspond to the selected dot adjust value obtaining process and determination of the adjust value by the selected dot adjust value obtaining process, wherein the automatic process and the manual process differ from each other in test patterns printed by the first printing and the second printing, and an adjusting precision for the positions of dots formed in the first printing and the second printing based on the adjust value determined by the manual processing is higher than that by the automatic processing.

9. A printing system according to claim 8, wherein each of the multiple kinds of dot adjust value obtaining process includes printing a plurality of test patterns with the adjust value differentiated in a predetermined range among the dot adjust value obtaining processes, and wherein at least one of the multiple kinds of dot adjust value obtaining process has the predetermined range different from those of another dot adjust value obtaining process.

* * * * *

UNITED STATES PATENT AND TRADEMARK OFFICE

CERTIFICATE OF CORRECTION

PATENT NO. : 7,258,429 B2
APPLICATION NO. : 10/929447
DATED : August 21, 2007
INVENTOR(S) : Kiichiro Takahashi et al.

It is certified that error appears in the above-identified patent and that said Letters Patent is hereby corrected as shown below:

COLUMN 1:
Line 46, “popular” should read -- frequent --.

COLUMN 2:
Line 50, “scan-based” should read -- scan based --.

COLUMN 3:
Line 30, “automatically set” should read -- automatically sets the --.

COLUMN 5:
Line 46, “the entire” should read -- the entire array of --.

COLUMN 8:
Line 37, “permitted” should read -- is permitted --.

COLUMN 9:
Line 47, “If no.” should read -- If no --.

COLUMN 13:
Line 54, “such a” should read -- such --.

COLUMN 14:
Line 4, “make decision of” should read -- make a decision on --.

COLUMN 15:
Line 2, “ates. When” should read -- ate. When --.

COLUMN 17:
Line 1, “applied” should read -- applied to --.
Line 45, “can be supplied ink” should read -- can be supplied with ink --.
Line 65, “applied” should be deleted.
Line 66, “signal.” should read -- signal is applied. --.

UNITED STATES PATENT AND TRADEMARK OFFICE

CERTIFICATE OF CORRECTION

PATENT NO. : 7,258,429 B2
APPLICATION NO. : 10/929447
DATED : August 21, 2007
INVENTOR(S) : Kiichiro Takahashi et al.

It is certified that error appears in the above-identified patent and that said Letters Patent is hereby corrected as shown below:

COLUMN 18:

Line 5, "applied" should be deleted, and "energy." should read -- energy is applied. --.

Line 49, "patterns" should read -- pattern --.

COLUMN 20:

Line 7, "patterns" should read -- pattern --.

Signed and Sealed this

Third Day of March, 2009

JOHN DOLL
*Acting Director of the United States Patent and Trademark Office*